US008141905B2

(12) United States Patent
Ball

(10) Patent No.: US 8,141,905 B2
(45) Date of Patent: Mar. 27, 2012

(54) SKI EQUIPMENT TOTE

(76) Inventor: William T. Ball, Colorado Springs, CO (US)

( * ) Notice: Subject to any disclaimer, the term of this patent is extended or adjusted under 35 U.S.C. 154(b) by 2387 days.

(21) Appl. No.: 10/290,778

(22) Filed: Nov. 8, 2002

(65) Prior Publication Data

US 2004/0090026 A1 May 13, 2004

(51) Int. Cl.
*A63C 11/00* (2006.01)

(52) U.S. Cl. ..... 280/809; 280/79.7; 280/47.131

(58) Field of Classification Search ..... 280/814, 280/815, 816, 818, 47.17, 47.19, 47.15, 37, 280/38, 47.131, 47.24, 47.26, 809, 79.7; 206/315.1; 211/70.5; 224/309, 323, 602, 224/917, 917.5; 294/137; D34/15
See application file for complete search history.

(56) References Cited

U.S. PATENT DOCUMENTS 1,481,223 A * 1/1924 Gorman et al. ..... 292/247
3,307,759 A * 3/1967 Fulton ..... 294/147
3,373,911 A 3/1968 Kebelbeck
3,504,921 A * 4/1970 Osmond ..... 280/8
3,550,999 A * 12/1970 Bogan ..... 280/47.19
3,590,608 A * 7/1971 Smyth et al. ..... 70/15
3,837,548 A * 9/1974 Nerger ..... 206/315.1
3,838,585 A * 10/1974 Foote ..... 70/18
3,909,031 A * 9/1975 Schmaedeke et al. ..... 280/814
3,917,137 A * 11/1975 Wilkins ..... 294/147
3,959,995 A * 6/1976 Fletcher ..... 70/18
4,114,915 A * 9/1978 Lello et al. ..... 280/47.19
4,126,254 A * 11/1978 Sahakian ..... 206/315.1
4,185,361 A * 1/1980 Stuart ..... 70/58
4,217,999 A * 8/1980 Forsman ..... 224/319
4,238,063 A * 12/1980 O'Dair ..... 206/315.1
4,254,888 A * 3/1981 Chandler ..... 220/694
4,268,050 A * 5/1981 Kennedy, Sr. ..... 280/38
4,358,137 A 11/1982 Gramm
D272,285 S * 1/1984 Gillett ..... D34/15
D273,905 S 5/1984 Rosen
4,643,302 A * 2/1987 Baumgardner ..... 206/315.1
4,666,184 A 5/1987 Garvey, Jr.
4,726,597 A * 2/1988 Hickin ..... 280/47.17
4,792,073 A * 12/1988 Jacober ..... 224/614
4,792,159 A 12/1988 Garvey, Jr. et al.
D301,789 S 6/1989 Tomoda
4,842,289 A * 6/1989 Samuels ..... 280/8
4,856,811 A 8/1989 Bressler et al.
4,860,935 A * 8/1989 Pavlinsky ..... 224/615
4,867,478 A * 9/1989 Anderson ..... 280/814
4,890,856 A * 1/1990 Mursch et al. ..... 280/646
4,953,773 A * 9/1990 Wirth ..... 224/328
5,096,104 A * 3/1992 Wirth ..... 224/580
5,106,112 A * 4/1992 Sargent ..... 280/40
5,160,075 A * 11/1992 Moscovitch ..... 224/328
D332,695 S * 1/1993 Moscovitch ..... D3/261
5,285,942 A * 2/1994 Wills ..... 224/328
5,340,153 A * 8/1994 Parker ..... 280/814
5,415,333 A * 5/1995 Wills ..... 224/328
5,425,545 A * 6/1995 McCusker ..... 280/30
5,640,855 A 6/1997 Crescenzo et al.
5,722,253 A 3/1998 Todd
5,758,770 A * 6/1998 Moneta ..... 206/379
5,799,848 A * 9/1998 Wills ..... 224/328

(Continued)

*Primary Examiner* — J. Allen Shriver, II
*Assistant Examiner* — Travis Coolman
(74) *Attorney, Agent, or Firm* — Zarley Law Firm, P.L.C.

(57) ABSTRACT

A transporting assembly having a housing with an open end, an opposite closed end, and a sidewall for receiving ski equipment that is mounted on wheels where a swing door is pivotally connected to the housing and can be secured to the housing.

17 Claims, 2 Drawing Sheets

U.S. PATENT DOCUMENTS

D401,727 S * 11/1998 Weideman et al. ..... D34/25
5,860,519 A * 1/1999 Meyer et al. ..... 206/315.3
6,070,906 A * 6/2000 Allen ..... 280/814
6,186,522 B1 * 2/2001 Weis ..... 280/37
6,457,762 B1 * 10/2002 Garutti ..... 294/147

* cited by examiner

SKI EQUIPMENT TOTE

BACKGROUND OF THE INVENTION

This invention relates generally to a transporting and storage device and more particularly to a device for transporting and storing ski equipment.

Transporting ski equipment from a vehicle, residence, or hotel can be a heavy, awkward, inconvenient, and cumbersome task. Some skiers carry skis and ski poles on their shoulders, in an upright position, or under their arms, while they maneuver stairs and pathways that are often snow and ice covered. Not only is this tiring, but it is also somewhat dangerous if the skier is wearing ski boots as ski boots do not have exceptional traction, which might result in a fall and injury. To reduce some of this risk, some skiers will carry their ski boots separately and wear street shoes to and from the slopes. While this reduces the risk of injury, this method also requires that a skier find a locker at the slope to store the street shoes while skiing.

To overcome these problems, carriers have been developed for transporting ski equipment. Such carriers allow a skier to more conveniently carry all the equipment at once to and from slopes. Examples of such carriers can be found in U.S. Pat. Nos. 4,358,137 and 4,856,811. These patents, however, disclose further problems. Particularly, a skier must dispose of the carrier in a locker.

In view of these problems, it is desirable to provide a transporting device that can be secured to a conventional ski rack available at most ski slopes, as well as provide a secured storage compartment for storing equipment such as street shoes and the like.

Thus, a principal objective of the invention is to provide a device that enables a skier to easily transport ski equipment to and from a ski slope.

A further objective is to provide a device that allows a skier to conveniently store and secure equipment at a ski slope.

Another objective is to provide a device that can be secured to any type of conventional rack at a ski slope.

A still further objective is to provide a device that allows a skier to store equipment in an upright position.

Various other objects, advantages, and features of the invention will become apparent to those skilled in the art from a reading of the disclosure.

BRIEF SUMMARY OF THE INVENTION

The transporting assembly has a housing with an open end, an opposite closed end, and a sidewall for receiving ski equipment that is mounted on wheels. Pivotally connected to the open end of the housing is a swing door that can be moved from an open position to a closed position and secured to the housing when in a closed position.

DESCRIPTION OF THE PREFERRED EMBODIMENTS

Figure 3:
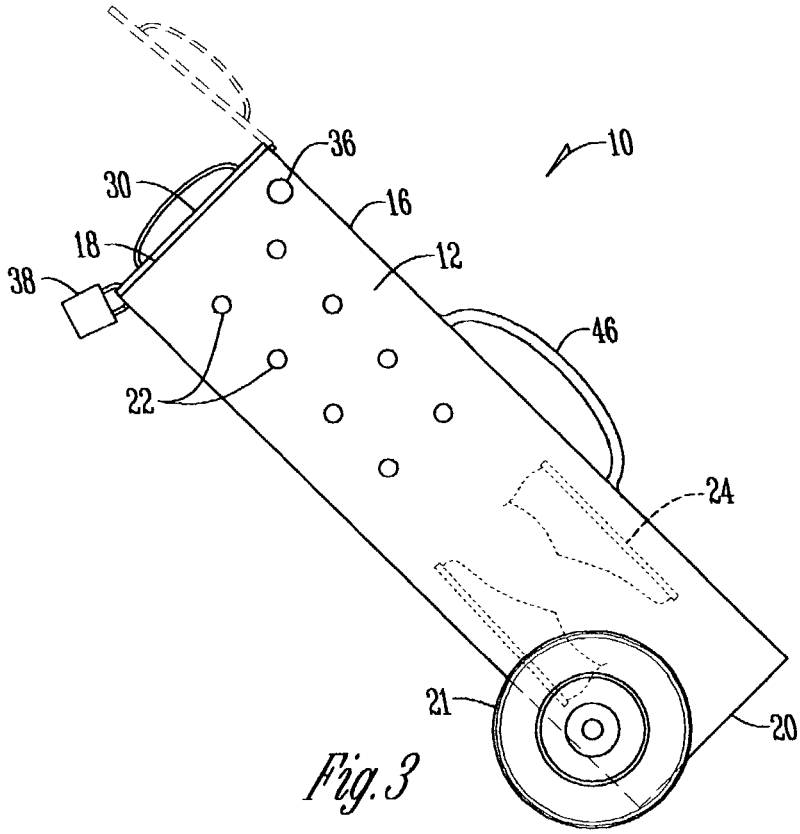
FIG. 3 is a side view of the invention with a swing door.
Figure 4:
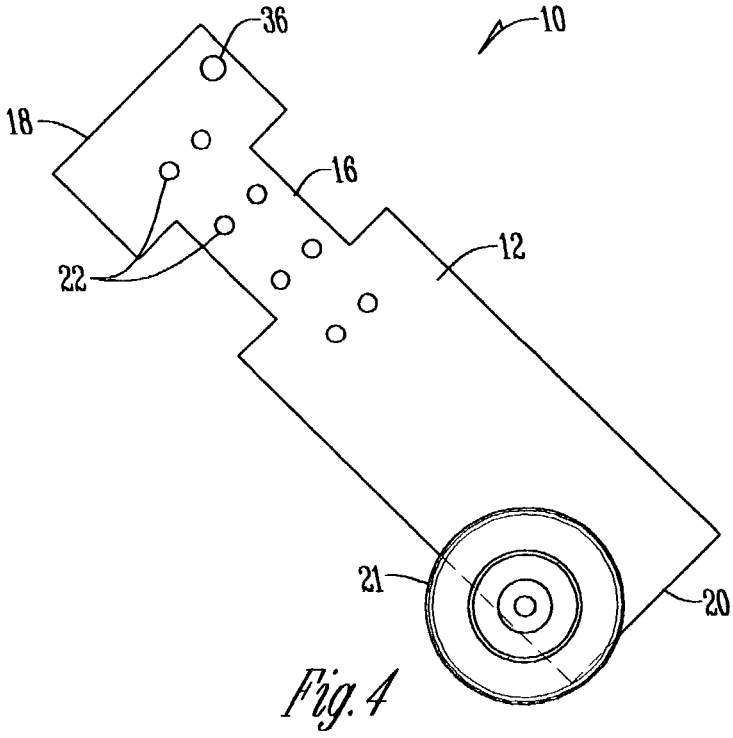
FIG. 4 is a side view of the invention with a notched housing.

The transporting device of this invention is generally referred to in the drawings by reference numeral 10. The device has a housing 12 for receiving ski equipment 14 with sidewall 16, an open end 18 and a closed end 20. The housing 12 can be of any shape and size but it is preferred that the sidewall 16 be generally cylindrical. The housing can be of a size that snuggly receives skis, or in another embodiment, as shown in FIG. 3, large enough to receive street shoes 24 or ski boots. In another embodiment, as shown in FIG. 4, the sidewalls 16 of the housing 12 are notched to fit any conventional ski rack.

A plurality of holes 22 that are positioned in opposite relation on the sidewall 16 of the housing are used to assist in securing the skis within the housing. A pair of cords 26, such as bungee cords, are connected to holes 22 and extend around the front part of the bindings 14A of the skis 14 and is connected to a hole on the opposite side of the sidewall 16 to secure the ski equipment 14 within the housing 12.

Figure 1:
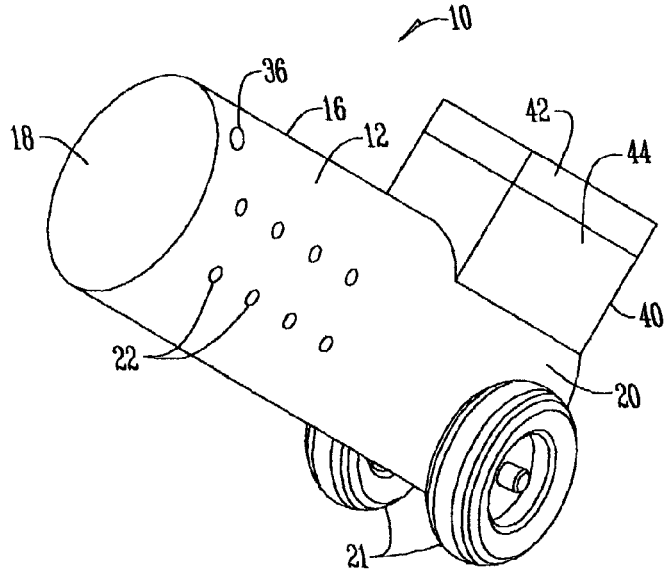
FIG. 1 is a perspective view of the invention.

The housing 12 is mounted on any conventional means for transporting the device such as a pair of wheels 21 or the like as shown in FIG. 1.

Pivotally connected to the open end 18 of the housing 12 is a swing door 30 that can be moved from an open position that allows access to the housing, to a closed position where the open end is covered as shown in FIG. 3. In this embodiment, a locking device such as a padlock 38 can secure the swing door 30 to the housing 12 when the swing door is in a closed position. See FIG. 3. As a result, a skier could place walking shoes in the housing 12 of the device 10 and lock the swing door 30 to protect against theft.

The device 10 is secured to a conventional ski rack with a locking means 32. (FIG. 2) While a number of different means can be used to secure the device 10 to a ski rack, preferred is the use of a chain or cord 34 that extends through a hole 36 located on the sidewall 16 of the housing 12 and around the ski rack and the opposite ends of the chain are secured with a padlock 38. In an alternative embodiment, the chain 34 can extend through oppositely disposed holes 36 and around the ski rack allowing a skier to hang the device 10 from the ski rack.

Figure 2:
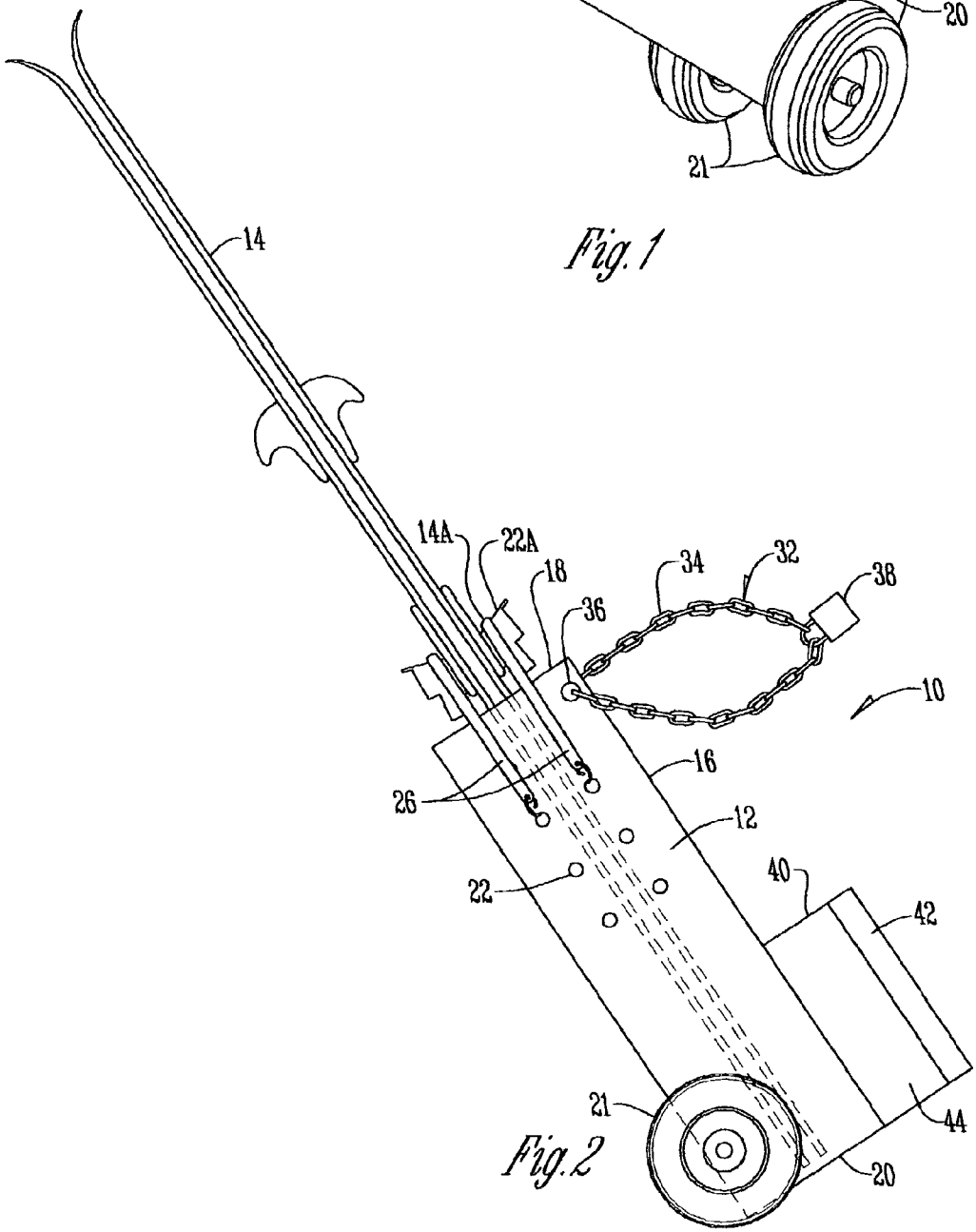
FIG. 2 is a side view of the invention.

In one embodiment, attached to the housing 12 is a lock box 40 as shown in FIGS. 1 and 2. The lock box, which has a top 42 pivotally connected to the bottom portion 44, allows a skier to store ski boots in the lock box while transporting the device, or storing walking shoes while skiing. The top 42 can be secured to the bottom 44 by a conventional means.

To assist in carrying and maneuvering the device, a handle 46 can be placed on the housing 12 or on the swing door 30. (FIG. 3) In addition, the plane of the closed end 20 of the housing is flush with the outer periphery of the wheels 21 to enable the device to stand on end for vertical storage of the ski equipment. This reduces the need for a storage rack at one's residence as well as the possibility of the ski edges damaging or marking a wall.

As can be seen from the foregoing disclosure, the device provides an easy means for transporting ski equipment where equipment can be stored and secured within the device as well as to a ski rack.

It will be appreciated by those skilled in the art that other various modifications could be made to the device without departing from the spirit and scope of this invention. All such modifications and changes fall within the scope of the claims are intended to be covered thereby.

What is claimed is:

1. A device for transporting ski equipment to a ski slope with a ski rack comprising:

a housing for receiving skis and ski equipment having sidewalls;

an open end, and an opposite closed end, and means for transporting the device mounted on the housing;

a swing door pivotally connected to the housing and positioned to cover the open end of the housing when the swing door is in a closed position; and a plurality of holes in the sidewalls of the housing and a securing member that is attached to one hole and extends around the ski equipment and at least partially around the housing where it is connected to the housing at the opposite end of the securing member.

2. The device of claim 1 further comprising a locking means for securing the swing door in the closed position.

3. The device of claim 1 further comprising wheels mounted on the housing.

4. The device of claim 3 wherein an outer periphery of the wheels is flush with the closed end of the housing such that the device stands vertically on the closed end.

5. The device of claim 1 further comprising a locking means for securing the device to the ski rack.

6. The device of claim 1 wherein the housing has a notch between the open end and the closed end for placement upon an automobile ski rack.

7. The device of claim 1 wherein at least one handle is connected to the housing.

8. The device of claim 1 further comprising a lock box connected to a sidewall of the housing.

9. The device of claim 8 wherein the lock box has a pivotal top.

10. A device for transporting skis and ski equipment to a ski slope with a ski rack comprising:

a housing for receiving the skis and ski equipment having sidewalls, an open end, an opposite closed end, and means for transporting the device mounted on the housing;

a storage container connected to a sidewall of the housing; and a plurality of holes in the sidewalls of the housing and a securing member that is attached to one hole and extends around the ski equipment and at least partially around the housing where it is connected to the housing at the opposite end of the securing member.

11. The device of claim 10 further comprising a locking means for securing the device to the ski rack.

12. The device of claim 10 wherein the housing has a notch between the open end and the closed end.

13. The device of claim 10 wherein at least one handle is connected to the housing.

14. The device of claim 10 further comprising a swing door pivotally connected to the housing and positioned to cover the open end of the housing when the swing door is in a closed position.

15. The device of claim 14 further comprising a handle placed on the swing door.

16. The device of claim 10 further comprising wheels mounted on the housing.

17. The device of claim 16 wherein an outer periphery of the wheels is flush with the closed end of the housing such that the device stands vertically on the closed end.

* * * * *